US007856188B2

(12) United States Patent
Shih et al.

(10) Patent No.: US 7,856,188 B2
(45) Date of Patent: Dec. 21, 2010

(54) DEVELOPING METHOD IN IMAGING-FORMING DEVICE

(75) Inventors: Eric Chun-Wei Shih, Hsinchu (TW); Dianne Tan-Feng Tsai, Hsinchu (TW)

(73) Assignee: Aetas Technology, Incorporated, Irvine, CA (US)

( * ) Notice: Subject to any disclaimer, the term of this patent is extended or adjusted under 35 U.S.C. 154(b) by 437 days.

(21) Appl. No.: 12/068,841

(22) Filed: Feb. 12, 2008

(65) Prior Publication Data

US 2008/0240755 A1 Oct. 2, 2008

(30) Foreign Application Priority Data

Apr. 2, 2007 (TW) ..... 96111676 A

(51) Int. Cl.
*G03G 15/01* (2006.01)
*G03G 15/22* (2006.01)

(52) U.S. Cl. ..... 399/50; 399/54; 399/55; 399/223

(58) Field of Classification Search ..... 399/50, 399/54, 55, 223, 226
See application file for complete search history.

(56) References Cited

U.S. PATENT DOCUMENTS

| | | | | |
|---|---|---|---|---|
| 5,576,824 | A * | 11/1996 | Folkins | 399/228 |
| 5,862,438 | A * | 1/1999 | Folkins | 399/88 |
| 7,548,716 | B2 * | 6/2009 | Radulski | 399/298 |
| 7,702,259 | B2 * | 4/2010 | Eun et al. | 399/223 |
| 2006/0291906 | A1 * | 12/2006 | Lee | 399/223 |
| 2007/0009272 | A1 * | 1/2007 | Sheen | 399/55 |
| 2008/0170883 | A1 * | 7/2008 | Chen et al. | 399/128 |

* cited by examiner

*Primary Examiner*—David M Gray
*Assistant Examiner*—Fred Braun
(74) *Attorney, Agent, or Firm*—Muncy, Geissler, Olds & Lowe, PLLC

(57) ABSTRACT

A developing method in an image-forming device is provided. The developing method includes the steps of charging a photoreceptor; exposing the photoreceptor to form a first latent image on the photoreceptor; developing the first latent image by a first developing unit having a first potential to form a first toner image; and discharging the photoreceptor having the first toner image, such that when the photoreceptor is charged again, the first toner image on the photoreceptor has a second potential, and the second potential is approximately the same as the first potential of the first developing unit.

18 Claims, 5 Drawing Sheets

| conditions | exposure time ($\mu$s) | $V_{S0}$ | $V_{S1}$ | $V_{DR}$ | $\Delta V_1$ ($V_{S1} - V_{DR}$) ghost image effect | | ghost image (particles/mm$^2$) | |
|---|---|---|---|---|---|---|---|---|
| no eraser | 9.58 | -756 | -660 | -760 | 96 | | | 74 |
| charging unit(1) eraser duty cycle 29.9% | 10.91 | -768 | -724 | -750 | 26 | | | 24 |
| | 10.64 | | -728 | | 22 | | | 24 |
| | 9.58 | | -732 | | 18 | | | 17 |
| charging unit(2) eraser duty cycle 29.9% | 10.91 | -796 | -744 | -750 | 6 | | | 9 |
| | 10.64 | | -744 | | 6 | | | 8 |
| | 9.58 | | -756 | | -6 | reduce | reduce | 8 |
| charging unit(2) eraser duty cycle 24.7% | 10.9 | -796 | -732 | -750 | 18 | | | 9 |
| charging unit(2) eraser duty cycle 21.3% | 10.9 | -796 | -732 | -750 | 18 | | | 6 |

Fig. 5

DEVELOPING METHOD IN IMAGING-FORMING DEVICE

RELATED APPLICATIONS

This application claims priority to Taiwan Patent Application Serial Number 96111676, filed Apr. 2, 2007, which is herein incorporated by reference.

BACKGROUND

1. Field of Invention

The present invention relates to a developing method in an image-forming device. More particularly, the present invention relates to a developing method that uses Image-on-Image (IOI) or Toner-on-Toner forming process in an image-forming device for color electro-photographic printing.

2. Description of Related Art

Electrophotographic systems are generally employed in image-forming devices, the operation of which involves several steps: charging, exposing, developing, transferring, and fusing.

However, when an Image-on-Image (IOI) forming process is used in the image-forming device, the printed image has ghost images and smears thereon.

Take for example the four-pass type IOI color image forming device having yellow, magenta, cyan and black developing units. After the charging, exposing and developing step of the $1^{st}$ pass, a yellow toner image is formed on the photoreceptor. After the charging step of the $2^{nd}$ pass, the yellow toner image has another surface potential, which is different from the potential of the magenta developing unit after the developing step of the $2^{nd}$ pass. Thus, the toners of the magenta developing unit are adhered to the yellow toner image due to the potential difference, and the ghost image is caused thereby. One way to reduce the potential difference between image area and non-image area is to apply erasing step, also called discharge step, at the end of each pass, which intends to bring the photoreceptor back to the neutral state before the next developing pass starts. By bringing down the residual charges, ghosting will be eliminated or reduced.

Furthermore, after the charging, exposing and developing step of each pass, the photoreceptor is discharged for the next pass. Taking the $2^{nd}$ pass for example, the magenta toner image is formed after the charging, exposing and developing step, and then the photoreceptor is discharged for the $3^{rd}$ pass. However, the toner-image region and the non-toner-image region on the photoreceptor still have a potential difference therebetween despite that the photoreceptor has been discharged for the $3^{rd}$ pass, such that the toners of the toner-image region are adhered to the non-toner-image region. FIG. 1 shows the potential difference on the photoreceptor after the discharging step during the $2^{nd}$ pass in the prior art. At the moment, the absolute value of the potential $V_{S2}$ of the toner-image region is larger than the absolute value of the potential $V_{SB}$ of the non-toner-image region, so the toners are adhered to the non-toner-image region due to the potential difference, to cause the smear problem.

For the foregoing reasons, there is a need to provide a developing method to solve the problem of low image quality caused by the ghost image and smear at the same time.

SUMMARY

In accordance with one embodiment of the present invention, a developing method in an image-forming device is provided. The developing method includes the steps of charging a photoreceptor; exposing the photoreceptor to form a first latent image on the photoreceptor; applying a first potential to a first developing unit for developing the first latent image to form a first toner image; and discharging the photoreceptor having the first toner image, such that the first toner image has a second potential and a non-image area outside the first toner image has a third potential, wherein an absolute value of the second potential is equal to or smaller than an absolute value of the third potential.

In accordance with another embodiment of the present invention, a developing method in an image-forming device is provided. The developing method includes the steps of charging a photoreceptor; exposing the photoreceptor to form a first latent image on the photoreceptor; applying a first potential to a first developing unit for developing the first latent image to form a first toner image; and controlling a duty cycle of an eraser to discharge the photoreceptor having the first toner image, such that the first toner image has a second potential and a non-image area outside the first toner image has a third potential.

In accordance with yet another embodiment of the present invention, a developing method in an image-forming device is provided. The developing method includes the steps of charging a photoreceptor; exposing the photoreceptor to form a first latent image on the photoreceptor; developing the first latent image by a first developing unit having a first potential V1 to form a first toner image; and discharging the photoreceptor having the first toner image, such that when the photoreceptor is charged once again, the first toner image on the photoreceptor has a second potential V2, wherein a percentage of an absolute value, which is of difference of the first potential V1 and the second potential V2, divided by an absolute value of the first potential V1 is less than 10%.

For the foregoing embodiments of the present invention, the developing method can be applied to avoid the ghost image and smear occurring on IOI development system, as a result, to improve the quality of the image formed by the image-forming device.

Both the foregoing general description and the following detailed description are exemplary and explanatory only and are not restrictive of the invention, as claimed. It is to be understood that both the foregoing general description and the following detailed description are exemplary, and are intended to provide further explanation of the invention as claimed.

BRIEF DESCRIPTION OF THE DRAWINGS

The invention can be more fully understood by reading the following detailed description of the embodiments, with reference made to the accompanying drawings as follows:

FIG. 5 shows an experimental table comparing erasers that have different duty cycles to perform discharging.

DESCRIPTION OF THE PREFERRED EMBODIMENTS

In the following detailed description, the embodiments of the present invention have been shown and described. As will be realized, the invention is capable of modification in various obvious respects, all without departing from the invention. Accordingly, the drawings and description are to be regarded as illustrative in nature, and not restrictive.

Figure 2:
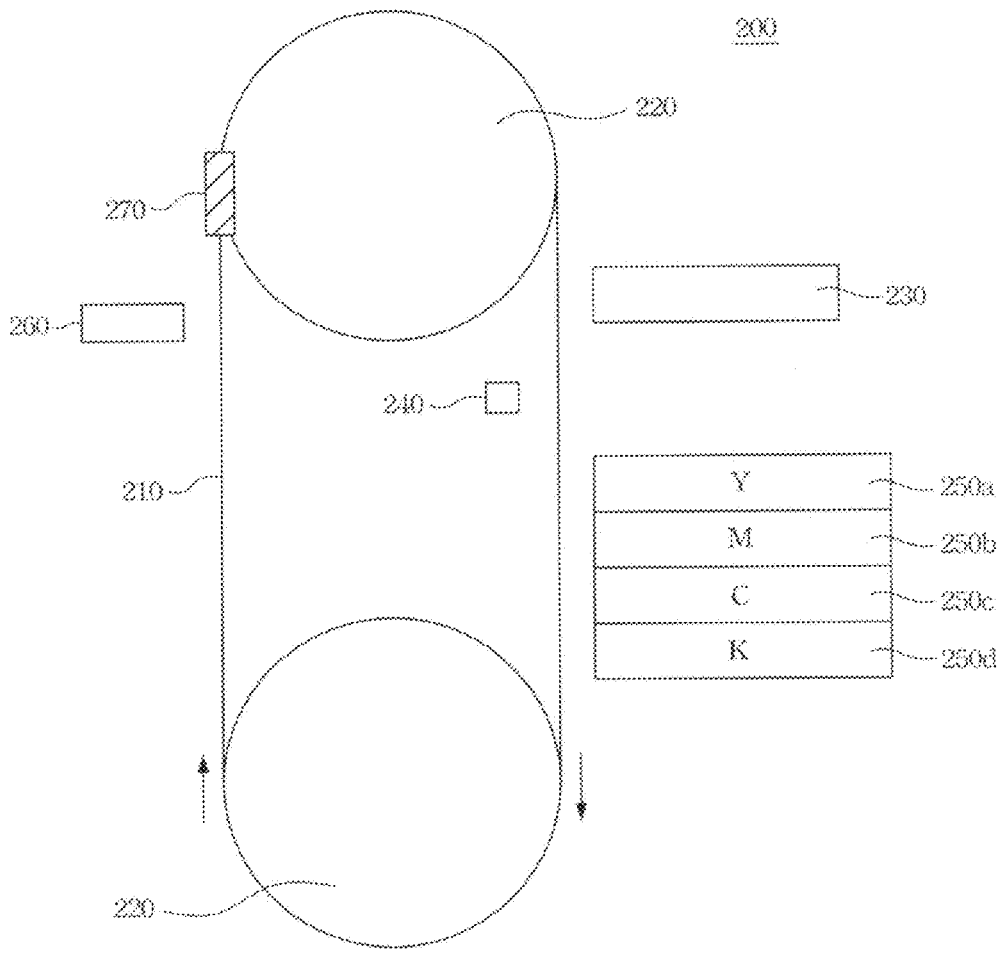
FIG. 2 shows an electrophotographic image-forming device.

FIG. 2 shows an electrophotographic image-forming device. The Image-on-Image (IOI) type image-forming device 200 includes a photoreceptor 210, a driving roller assembly 220, a charging unit 230, an exposure element 240, an eraser 260 and four developing units 250, i.e. yellow developing unit 250*a*, magenta developing unit 250*b*, cyan developing unit 250*c* and black developing unit 250*d*. The photoreceptor 210 is mounted on the driving roller assembly 220 and rotates circularly with the driving roller assembly 220 in the direction indicated by the arrow shown in FIG. 2. The photoreceptor 210 can be a belt or a drum, and the charging unit 230 can be a corona charging device such as a corotron or a scorotron. Further, the exposure element 240 can be a laser or an LED imaging device.

Figure 3:
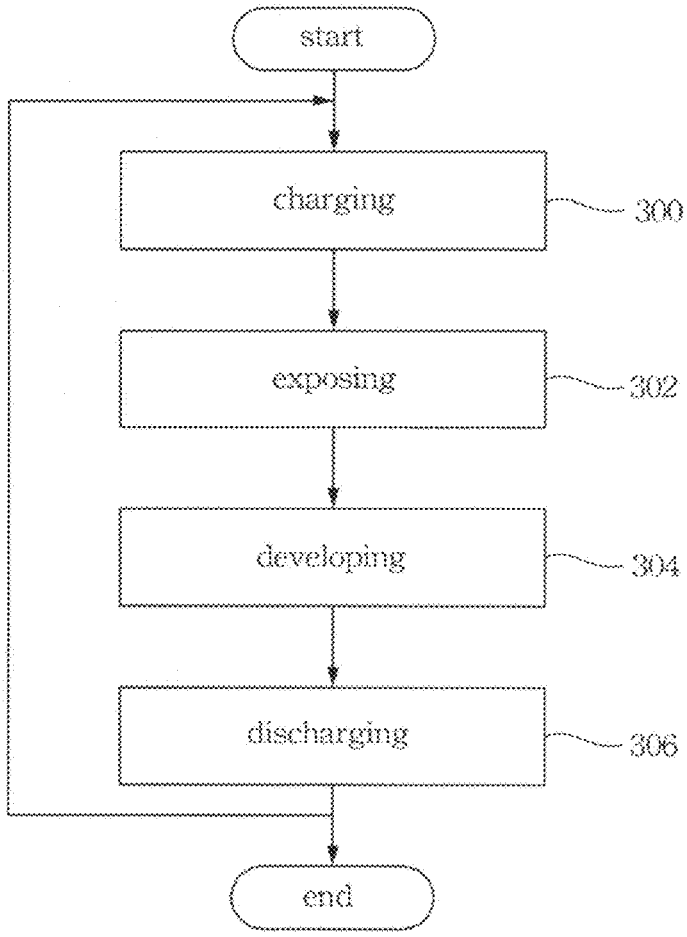
FIG. 3 shows a flow chart of the developing method according to one embodiment of the present invention.

FIG. 3 shows a flow chart of the developing method according to one embodiment of the present invention. Refer to FIGS. 2 and 3. When the image-forming device 200 forms the image to be printed, a $1^{st}$ pass is performed. The charging unit 230 charges the photoreceptor 210 for the first time, such that the photoreceptor 210 is charged with uniform charges (Step 300). Then, the image to be printed is converted into an optical signal by the exposure element 240, and the optical signal is irradiated on the photoreceptor 210, which has already been charged with the uniform charges, to start the exposing step (Step 302), so that the irradiated region has a reduced potential than the un-irradiated region (the absolute value of the potential of the irradiated region is smaller than the absolute value of the potential of the un-irradiated region). Such a potential difference is used to represent the potential image, also called the latent image 270, and the exposed region represents the first latent image region.

After the latent image 270 is formed on the photoreceptor 210, a first potential is applied to a single developing unit in accordance with the first latent image region. For example, the first potential (V1) is applied to the yellow developing unit 250*a*, such that the toners of the yellow developing unit 250*a* are adhered to the first latent image region with higher absolute potential value because of the electrostatic force. Thus, all necessary toners can be adhered to the first latent image region to complete the developing step, to form a yellow toner image (Step 304).

Figure 1:
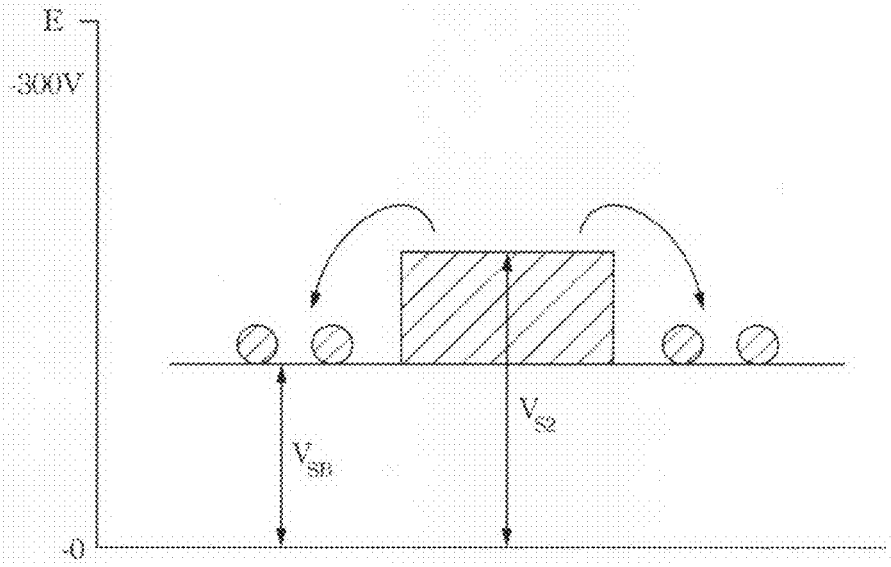
Fig. 1 (PRIOR ART)
FIG. 1 shows the potential difference on the photoreceptor after the discharging step during the $2^{nd}$ pass in the prior art; the developed toner layer will be drawn to the area of non-imaged area where has lower absolute potential value, as shown by the arrow signs.

Then, the eraser 260 discharges the photoreceptor 210 having the yellow toner image (Step 306), so as to remove the charges on the photoreceptor 210 for the charging step of the $2^{nd}$ pass. It is noticed that, after the discharging step, the reason why the absolute potential value of the non-toner-image region is smaller than the absolute potential value of the toner-image region as shown in FIG. 1 to cause the smear is that the toner-image region on the photoreceptor 210 is less sensitive to the charging unit 230 and the eraser 260, so the charges in the toner-image region are removed slower during the discharging process. If erasing practice removes the charges on the photoreceptor 210 as much as possible by increasing the efficiency of the eraser 260 or the duration of the discharging process, the result will be that the absolute potential value of the non-toner-image region is smaller than the absolute potential value of the toner-image region as shown in FIG. 1, so that the toners adhered in the toner-image region will be attracted due to the potential of the non-toner-image region and cause the smear. The method in the embodiment of the present invention is provided to remove a part of the charges from the photoreceptor 210, such as removing one-third to half of the charges, so that the absolute potential value of the non-toner-image region is not smaller than the absolute potential value of the toner-image region, and the toners are not attracted to the non-toner-image region to cause smear. Furthermore, when the photoreceptor 210 is charged again, the potential of the yellow toner image on the photoreceptor 210 can be accordingly maintained at a second potential (V2), and the absolute value of the second potential is approximately the same as the absolute value of the first potential of the yellow developing unit 250*a*. It is noticed that the difference herein between the second potential (V2) and the first potential (V1) is far smaller than that in the prior art. In one embodiment, a percentage of an absolute value, which is of difference of the first potential (V1) and the second potential (V2), divided by an absolute value of the first potential (V1) is less than 10%, i.e. $\Delta V/|V1|<10\%$, $\Delta V=|V1-V2|$. In a preferred embodiment, the absolute value of the second potential is totally the same as the absolute value of the first potential of the yellow developing unit 250*a*.

After the $1^{st}$ pass is completed, the process returns back to Step 300 to perform the $2^{nd}$ pass. The charging unit 230 charges the photoreceptor 210 for the second time (Step 300), and then a second latent image region with higher absolute potential value is formed on the photoreceptor 210 by the exposure element 240 (Step 302). After that, the first potential is applied to the developing unit in accordance with the second latent image region for the developing process (Step 304). For example, the first potential is applied to the magenta developing unit 250*b* for the developing process, so as to form a magenta toner image. The second potential of the yellow toner image and the first potential of the magenta developing unit 250*b* have a very small difference (even no difference) therebetween, so the toners of the magenta developing unit 250*b* with the first potential would not be adhered to the yellow toner image and cause the ghost image, which is due to the potential difference between the yellow toner image and the magenta developing unit 250*b*.

Figure 4:
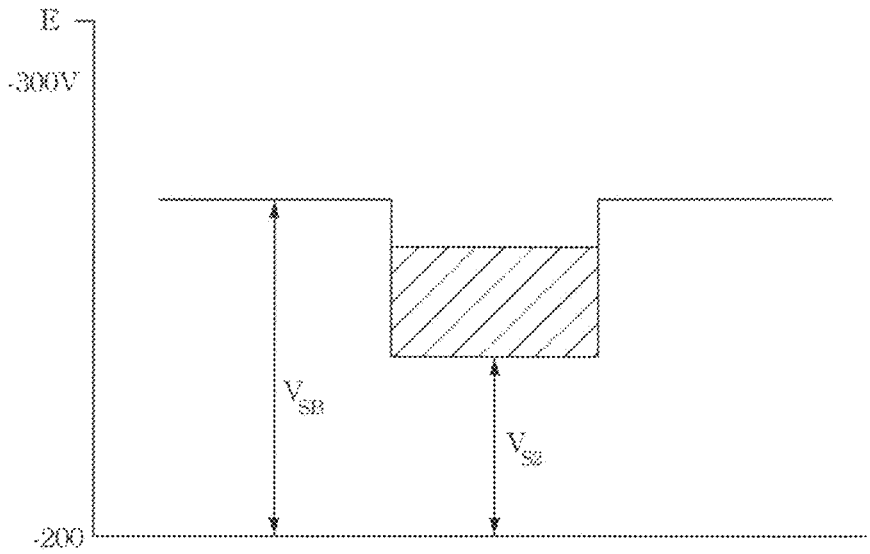
FIG. 4 shows the potential difference on the photoreceptor after the discharging step during the $2^{nd}$ pass.

Moreover, the eraser 260 discharges the photoreceptor 210 having the yellow and magenta toner image (Step 306), so as to remove the charges on the photoreceptor 210 for the charging step of the $3^{rd}$ pass. It is noticed that the toner-image region on the photoreceptor 210 is less sensitive to the charging unit 230 and the eraser 260, so the charges in the toner-image region are not completely removed during the discharging process. Instead, only a part of the charges is removed from the photoreceptor 210, such as removing one-third to half of the charges from the photoreceptor 210, so that after the discharging process, the yellow and magenta toner image can be maintained at a third potential, and the non-toner-image region outside the yellow and magenta toner image can be maintained at a fourth potential, in which the absolute value of the third potential is approximately the same as the absolute value of the fourth potential, or even smaller than the absolute value of the fourth potential. FIG. 4 shows the potential difference on the photoreceptor after the discharging step during the $2^{nd}$ pass. At the moment, the absolute value of the potential $V_{S2}$ of the toner-image region is smaller than the absolute value of the potential $V_{SB}$ of the non-toner-image region, so the toners are not adhered to the non-toner-image region. As a result, the problem, which the absolute potential value of the toner-image region is larger than the absolute potential value of the non-toner-image region such that the toners in the toner-image region are adhered to the non-toner-image region to cause the smear, can be avoided.

Furthermore, after the discharging step during the $2^{nd}$ pass and charging the photoreceptor 210 again, the potential of the yellow and magenta toner image on the photoreceptor 210 can be maintained at a fifth potential, and the absolute value of the fifth potential is approximately the same as the absolute value of the first potential of the magenta developing unit 250*b*. It is noticed that the difference herein between the fifth potential and the first potential is far smaller than that in the prior art. In a preferred embodiment, the absolute value of the fifth potential is totally the same as the absolute value of the first potential of the magenta developing unit 250*b*. As a result, during the $3^{rd}$ pass, the toners of the cyan developing unit 250*c* with the first potential would not be adhered to the yellow and magenta toner image and cause the ghost image, which is due to the potential difference between the yellow and magenta toner image and the cyan developing unit 250*c*.

After completing the IOI process by charging, exposing, developing and discharging the photoreceptor, as described in the foregoing embodiment of the present invention, the transferring process is performed; that is, the formed image is transferred to the substrate, e.g. papers or other things for printing, for the fusing process at last. At the moment, after the transferring process is finished, the photoreceptor 210 can be discharged completely, i.e. deep erasing or deep cleaning, so as to remove the charges that remain on the photoreceptor 210 after the transferring process.

In the foregoing discharging step (Step 306), the control of the potential of the photoreceptor 210 and the toner image thereon is determined by the duty cycle of the eraser 260, and the duty cycle is 10% to 50%, preferably 20% to 30%. FIG. 5 shows an experimental table comparing erasers that have different duty cycles to perform discharging. As shown in FIG. 5, when the eraser has the duty cycle 29.9%, the initial potential (maximum absolute value of charging potential) $V_{S0}$ of the charging unit (2) is −796 V and the potential $V_{DR}$ of the developing unit is −750 V, the potential $V_{S1}$ of the toner image, which is formed after the $1^{st}$ pass and the recharging step, and the potential $V_{DR}$ of the developing unit have a smallest difference $\Delta V_1$ therebetween; that is, they have least ghost image effect therebetween.

It is noticed that as is understood by a person skilled in the art, the conditions shown in FIG. 5 are illustrative of the present invention rather than limiting of the present invention. It is intended to cover various conditions, such as the duty cycle of the eraser, the initial potential $V_{S0}$ of the charging unit, the potential $V_{DR}$ of the developing unit and the exposure time, and similar arrangements included within the spirit and scope of the appended claims, such that the photoreceptor 210 and the toner image thereon can be prevented from the ghost image and the smear effect after the discharging step (Step 306).

Furthermore, at the end of image forming step (after the transferring process is finished), a complete erasing step (deep erasing or deep cleaning) can be applied on the photoreceptor to form a natural potential on the photoreceptor.

For the foregoing embodiments of the present invention, the developing method can be applied to reduce the volume and production costs of the image-forming device and to avoid the ghost image and smear effect occurring on IOI development system, as a result, to improve the quality of the image formed by the image-forming device.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A developing method in an image-forming device, comprising the steps of:

(a) charging a photoreceptor;

(b) exposing the photoreceptor to form a first latent image on the photoreceptor;

(c) applying a first potential to a first developing unit for developing the first latent image to form a first toner image; and (d) discharging the photoreceptor having the first toner image, such that the first toner image has a second potential and a non-image area outside the first toner image has a third potential, and such that when the photoreceptor is charged again, the first toner image on the photoreceptor has a fourth potential, and the fourth potential is approximately the same as the first potential of the first developing unit, wherein an absolute value of the second potential is equal to or smaller than an absolute value of the third potential.

2. The developing method as claimed in claim 1, wherein the fourth potential is the same as the first potential.

3. The developing method as claimed in claim 1, wherein the discharging step of the step (d) is not referred to completely removing charges on the photoreceptor.

4. The developing method as claimed in claim 3, wherein the discharging step of the step (d) referred to the discharge down to one half to one third of the potential on the photoreceptor, so that the absolute potential value of the non-image area is slightly higher than the absolute potential value of the image area on the photoreceptor.

5. The developing method as claimed in claim 1, wherein the discharging step of the step (d) is referred to controlling a duty cycle of an eraser to discharge the photoreceptor.

6. A developing method in an image-forming device, comprising the steps of:

(a) charging a photoreceptor;

(b) exposing the photoreceptor to form a first latent image on the photoreceptor;

(c) applying a first potential to a first developing unit for developing the first latent image to form a first toner image; and (d) controlling a duty cycle of an eraser to discharge the photoreceptor having the first toner image, such that the first toner image has a second potential and a non-image area outside the first toner image has a third potential, and such that when the photoreceptor is charged again, the first toner image on the photoreceptor has a fourth potential, and the fourth potential is approximately the same as the first potential of the first developing unit.

7. The developing method as claimed in claim 6, wherein a value of the second potential is equal to or smaller than a value of the third potential.

8. The developing method as claimed in claim 6, wherein the second potential is approximately the same as the first potential of the first developing unit.

9. The developing method as claimed in claim 6, wherein the discharging step of the step (d) is referred to removing one-third to half of charges on the photoreceptor.

10. The developing method as claimed in claim 6, wherein the duty cycle of the eraser is 10% to 50%.

11. The developing method as claimed in claim 6, wherein the duty cycle of the eraser is 20% to 30%.

12. A developing method in an image-forming device, comprising the steps of:

(a) charging a photoreceptor;

(b) exposing the photoreceptor to form a first latent image on the photoreceptor;

(c) developing the first latent image by a first developing unit having a first potential V1 to form a first toner image; and (d) discharging the photoreceptor having the first toner image, such that when the photoreceptor is charged again, the first toner image on the photoreceptor has a second potential V2;

wherein a percentage of an absolute value, which is of difference of the first potential V1 and the second potential V2, divided by an absolute value of the first potential V1 is less than 10%.

13. The developing method as claimed in claim 12, further comprising the steps of:

(e) charging the photoreceptor, such that the first toner image on the photoreceptor has the second potential;

(f) exposing the photoreceptor to form a second latent image on the photoreceptor;

(g) developing the second latent image by a second developing unit having the first potential to form a second toner image; and (h) discharging the photoreceptor having the second toner image, such that the second toner image has a third potential and a non-image area outside the second toner image has a fourth potential, wherein a value of the third potential is equal to or smaller than a value of the fourth potential.

14. The developing method as claimed in claim 13, wherein the step (h) further comprises the step of:

(i) discharging the photoreceptor having the second toner image, such that when the photoreceptor is charged again, the second toner image on the photoreceptor has a fifth potential, and the fifth potential is approximately the same as the first potential of the first developing unit.

15. The developing method as claimed in claim 14, wherein the fifth potential is the same as the first potential.

16. The developing method as claimed in claim 12, wherein the discharging step of the step (d) is not referred to completely removing charges on the photoreceptor.

17. The developing method as claimed in claim 16, wherein the discharging step of the step (d) is referred to removing one-third to half of charges on the photoreceptor, so that the absolute potential value of the non-image area is slightly higher than the absolute potential value of the image area on the photoreceptor.

18. The developing method as claimed in claim 12, wherein the second potential is the same as the first potential.

* * * * *